US008441404B2

(12) United States Patent
Chiang et al.

(10) Patent No.: US 8,441,404 B2
(45) Date of Patent: May 14, 2013

(54) FEED NETWORKS FOR SLOT ANTENNAS IN ELECTRONIC DEVICES

(75) Inventors: Bing Chiang, Cupertino, CA (US); Gregory Allen Springer, Sunnyvale, CA (US); Douglas B. Kough, San Jose, CA (US); Enrique Ayala, Watsonville, CA (US); Matthew Ian McDonald, San Jose, CA (US)

(73) Assignee: Apple Inc., Cupertino, CA (US)

( * ) Notice: Subject to any disclaimer, the term of this patent is extended or adjusted under 35 U.S.C. 154(b) by 1290 days.

(21) Appl. No.: 11/959,165

(22) Filed: Dec. 18, 2007

(65) Prior Publication Data

US 2009/0153410 A1 Jun. 18, 2009

(51) Int. Cl.
*H01Q 13/10* (2006.01)

(52) U.S. Cl.
USPC ..... 343/770

(58) Field of Classification Search ..... 343/767, 343/770, 700 MS
See application file for complete search history.

(56) References Cited

U.S. PATENT DOCUMENTS

| | | | | |
|---|---|---|---|---|
| 6,369,771 | B1 | 4/2002 | Chiang et al. | |
| 6,473,042 | B1 * | 10/2002 | Fang et al. | 343/700 MS |
| 6,670,923 | B1 | 12/2003 | Kadambi et al. | |
| 6,677,909 | B2 * | 1/2004 | Sun et al. | 343/767 |
| 6,741,214 | B1 | 5/2004 | Kadambi et al. | |
| 6,747,601 | B2 | 6/2004 | Boyle | |
| 6,774,852 | B2 | 8/2004 | Chiang et al. | |
| 6,856,294 | B2 | 2/2005 | Kadambi et al. | |
| 6,888,510 | B2 | 5/2005 | Jo et al. | |
| 6,980,154 | B2 | 12/2005 | Vance et al. | |
| 7,027,838 | B2 | 4/2006 | Zhou et al. | |
| 7,116,267 | B2 | 10/2006 | Schuster et al. | |
| 7,119,747 | B2 | 10/2006 | Lin et al. | |
| 7,123,208 | B2 | 10/2006 | Puente Baliarda et al. | |
| 7,239,290 | B2 | 7/2007 | Poilasne et al. | |
| 2003/0107518 | A1 | 6/2003 | Li et al. | |
| 2004/0145521 | A1 | 7/2004 | Hebron et al. | |
| 2005/0017914 | A1 * | 1/2005 | Huang | 343/770 |
| 2005/0200545 | A1 * | 9/2005 | Bancroft | 343/770 |
| 2006/0055606 | A1 | 3/2006 | Boyle | |
| 2006/0284778 | A1 * | 12/2006 | Sanford et al. | 343/770 |

OTHER PUBLICATIONS

Hill et al. U.S. Appl. No. 11/650,187, filed Jan. 4, 2007.
Hill et al. U.S. Appl. No. 11/821,192, filed Jun. 21, 2007.

(Continued)

*Primary Examiner* — Robert Karacsony
(74) *Attorney, Agent, or Firm* — Treyz Law Group; G. Victor Treyz; David C. Kellogg

(57) ABSTRACT

Electronic devices and antennas for electronic devices are provided. The antennas may have ground plane elements with dielectric-filled openings. The dielectric-filled openings may be configured to form one or more rectangular slots. The antennas may be fed using transmission lines having first and second conductors. The first conductor of a given transmission line may be coupled to the ground plane element on one side of the slots. The second conductor of the transmission line may be coupled to a planar conductive element. The planar conductive element may couple to the ground plane element on the other side of the slots. The slots may be separated by a portion of the ground plane element. The planar conductive element may bridge at least one of the slots and may overlap the portion of the ground plane element that separates the slots without electrically contacting that portion of the ground plane element.

28 Claims, 18 Drawing Sheets

OTHER PUBLICATIONS

Hill et al. U.S. Appl. No. 11/897,033, filed Aug. 28, 2007.
Zhang et al. U.S. Appl. No. 11/895,053, filed Aug. 22, 2007.
Chiang et al. U.S. Appl. No. 11/702,039, filed Feb. 1, 2007.
R. Bancroft "A Commercial Perspective on the Development and Integration of an 802.11a/b/g HiperLan/WLAN Antenna into Laptop Computers", IEEE Antennas and Propagation Magazine, vol. 48, No. 4, Aug. 2006, pp. 12-18.
B. Chiang et al. "Invasion of Inductor and Capacitor Chips in the Design of Antennas and Platform Integration", IEEE International Conference on Portable Information Devices, May 2007, pp. 1-4.
A. Lai et al. "Infinite Wavelength Resonant Antennas With Monopolar Radiation Pattern Based on Periodic Structures", IEEE Transactions on Antennas and Propagation, vol. 55, No. 3, Mar. 2007, pp. 868-876.

* cited by examiner

FEED NETWORKS FOR SLOT ANTENNAS IN ELECTRONIC DEVICES

BACKGROUND

This invention relates to antennas, and more particularly, to feed networks for slot antennas in electronic devices.

Due in part to their mobile nature, portable electronic devices are often provided with wireless communications capabilities. Portable electronic devices may use wireless communications to communicate with wireless base stations. For example, cellular telephones may communicate using cellular telephone bands at 850 MHz, 900 MHz, 1800 MHz, and 1900 MHz (e.g., the main Global System for Mobile Communications or GSM cellular telephone bands). Portable electronic devices may also use other types of communications links. For example, portable electronic devices may communicate using the Wi-Fi® (IEEE 802.11) bands at 2.4 GHz and 5.0 GHz and the Bluetooth® band at 2.4 GHz. Communications are also possible in data service bands such as the 3 G data communications band at 2100 MHz band (commonly referred to as UMTS or Universal Mobile Telecommunications System).

To satisfy consumer demand for small form factor wireless devices, manufacturers are continually striving to reduce the size of components that are used in these devices. For example, manufacturers have made attempts to miniaturize the antennas used in portable electronic devices.

A typical antenna may be fabricated by patterning a metal layer on a circuit board substrate or may be formed from a sheet of thin metal using a foil stamping process. These techniques can be used to produce internal antennas that fit within the tight confines of a compact portable device such as a handheld electronic device. With conventional portable electronic devices, however, design compromises are made to accommodate such antennas. These design compromises may include, for example, compromises related to antenna efficiency and antenna bandwidth. It can therefore be difficult to integrate conventional antennas into electrical devices while maintaining satisfactory performance.

It would therefore be desirable to be able to provide improved antenna structures for electronic devices such as portable electronic devices.

SUMMARY

Electronic devices and antennas for electronic devices are provided. The electronic devices may be desktop computers or other computing equipment, portable electronic devices such as laptop or tablet computers, or handheld electronic devices such as devices with music player and wireless communications capabilities.

The electronic devices may have ground plane elements. The ground plane elements may be formed from a portion of a conductive device housing or from internal structures such as conductive layers on printed circuit boards.

Antennas may be formed from one or more dielectric-filled openings in the ground plane elements. For example, an antenna may be formed from one or more dielectric-filled rectangular slots in a ground plane element. The dielectric-filled slots may have lengths that are configured so that the slots serve as antenna resonating elements for the antenna in communications bands of interest. For example, one slot may be configured to have a length that is suitable for handling communications in a first communications band whereas another slot may be configured to have a length that is suitable for handling communications in a second communications band.

An antenna may be fed using a coaxial cable or other transmission line that has first and second conductors. The first conductor of a given transmission line may be coupled to the ground plane element on one side of the slots. The second conductor of the transmission line may be coupled to a planar conductive element. The planar conductive element may couple to the ground plane element on the other side of the slots. The slots may be separated by a portion of the ground plane element. The planar conductive element may bridge at least one of the slots and may overlap the portion of the ground plane element that separates the slots without electrically contacting that portion of the ground plane element.

Further features of the invention, its nature and various advantages will be more apparent from the accompanying drawings and the following detailed description of the preferred embodiments.

DETAILED DESCRIPTION

The present invention relates generally to antennas and antenna feed arrangements for wireless electronic devices.

The wireless electronic devices may be any suitable electronic devices. As an example, the wireless electronic devices may be desktop computers or other computer equipment. The wireless electronic devices may also be portable electronic devices such as laptop computers or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices. With one suitable arrangement, the portable electronic devices may be handheld electronic devices.

Examples of portable and handheld electronic devices include cellular telephones, media players with wireless communications capabilities, handheld computers (also sometimes called personal digital assistants), remote controls, global positioning system (GPS) devices, and handheld gaming devices. The devices may also be hybrid devices that combine the functionality of multiple conventional devices. Examples of hybrid devices include a cellular telephone that includes media player functionality, a gaming device that includes a wireless communications capability, a cellular telephone that includes game and email functions, and a handheld device that receives email, supports mobile telephone calls, has music player functionality and supports web browsing. These are merely illustrative examples.

Figure 1:
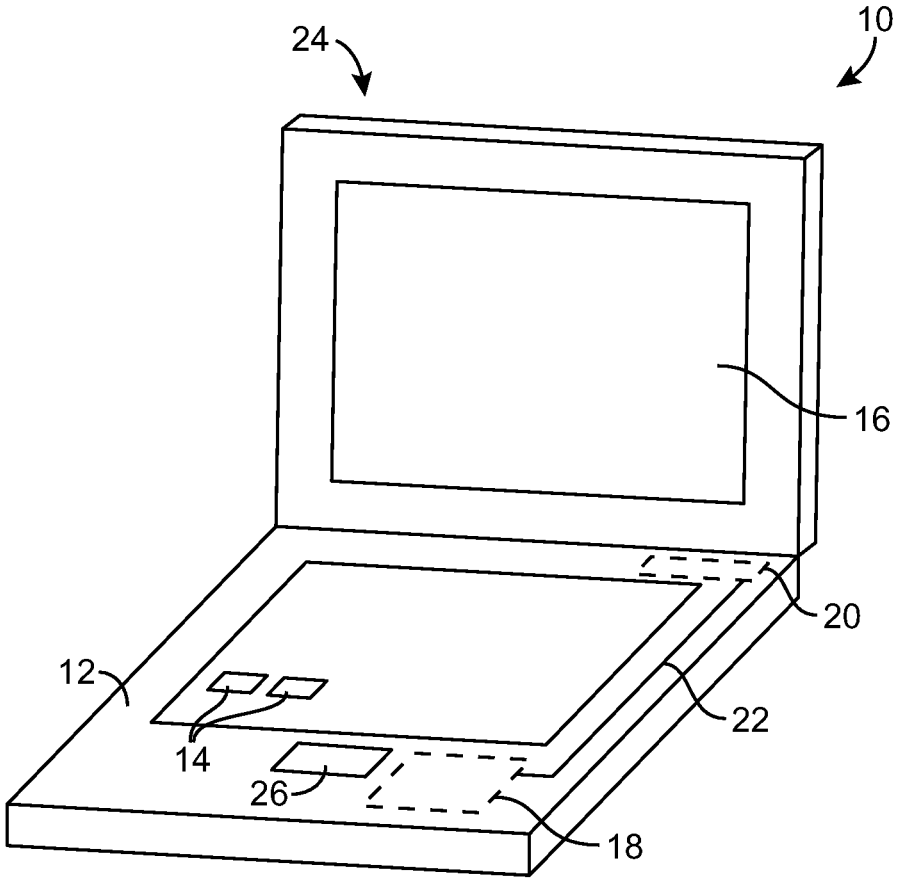
FIG. 1 is a perspective view of an illustrative electronic device such as a portable electronic device that may be provided with slot antennas in accordance with an embodiment of the present invention.

An illustrative electronic device such as a portable electronic device in accordance with an embodiment of the present invention is shown in FIG. 1. Device 10 may be any suitable electronic device. As an example, device 10 may be a laptop computer.

Device 10 may handle communications over one or more communications bands. For example, wireless communications circuitry in device 10 may be used to handle cellular telephone communications in one or more frequency bands and data communications in one or more communications bands. Typical data communications bands that may be handled by the wireless communications circuitry in device 10 include the 2.4 GHz band that is sometimes used for Wi-Fi® (IEEE 802.11) and Bluetooth® communications, the 5.0 GHz band that is sometimes used for Wi-Fi communications, the 1575 MHz Global Positioning System band, and 3 G data bands (e.g., the UMTS band at 1920-2170). These bands may be covered using single-band and multiband antennas. For example, cellular telephone communications can be handled using a multiband cellular telephone antenna and local area network data communications can be handled using a multiband wireless local area network antenna. As another example, device 10 may have a single multiband antenna for handling communications in two or more data bands (e.g., at 2.4 GHz and at 5.0 GHz).

Device 10 may have housing 12. Housing 12, which is sometimes referred to as a case, may be formed of any suitable materials including plastic, glass, ceramics, metal, other suitable materials, or a combination of these materials. In some situations, portions of housing 12 may be formed from a dielectric or other low-conductivity material, so as not to disturb the operation of conductive antenna elements that are located in proximity to housing 12.

In other situations, housing 12 will be partly or entirely formed from conductive materials such as metal. An illustrative conductive housing material that may be used is anodized aluminum. Aluminum is relatively light in weight and, when anodized, has an attractive insulating and scratch-resistant surface. If desired, other conductive materials can be used for the housing of device 10, such as stainless steel, magnesium, titanium, alloys of these metals and other metals, etc. In scenarios in which housing 12 is formed from conductive elements, one or more of the conductive elements may be used as part of the antenna in device 10. For example, metal portions of housing 12 and metal components in housing 12 may be shorted together to form a ground plane in device 10 or to expand a ground plane structure that is formed from a planar circuit structure such as a printed circuit board structure (e.g., a printed circuit board structure used in forming antenna structures for device 10). The ground plane may be used in forming the antenna.

Device 10 may have one or more buttons such as buttons 14. Buttons 14 may be formed on any suitable surface of device 10. In the example of FIG. 1, buttons 14 have been formed on the top surface of device 10. Buttons 14 may form a keyboard on a laptop computer (as an example).

If desired, device 10 may have a display such as display 16. Display 16 may be a liquid crystal diode (LCD) display, an organic light emitting diode (OLED) display, a plasma display, or any other suitable display. The outermost surface of display 16 may be formed from one or more plastic or glass layers. If desired, touch screen functionality may be integrated into display 16. Device 10 may also have a separate touch pad device such as touch pad 26. An advantage of integrating a touch screen into display 16 to make display 16 touch sensitive is that this type of arrangement can save space and reduce visual clutter. Buttons 14 may, if desired, be arranged adjacent to display 16. With this type of arrangement, the buttons may be aligned with on-screen options that are presented on display 16. A user may press a desired button to select a corresponding one of the displayed options.

Device 10 may have circuitry 18. Circuitry 18 may include storage, processing circuitry, and input-output components. Wireless transceiver circuitry in circuitry 18 may be used to transmit and receive radio-frequency (RF) signals. Transmission lines such as coaxial transmission lines and microstrip transmission lines may be used to convey radio-frequency signals between transceiver circuitry and antenna structures in device 10. As shown in FIG. 1, for example, transmission line 22 may be used to convey signals between antenna 20 and circuitry 18. Transmission line 22 may be, for example, a coaxial cable that is connected between an RF transceiver (sometimes called a radio) and an antenna.

Antennas such as antenna 20 may be located adjacent to keys 14 as shown in FIG. 1 or may be located in other suitable locations (e.g., top cover surface 24 of housing 12). These are merely illustrative locations for antenna 20. Antenna 20 may be formed on any suitable portion of an electronic device if desired.

Antenna 20 and the wireless communications circuitry of device 10 may support communications over any suitable wireless communications bands. For example, wireless communications circuitry in device 10 may be used to cover communications frequency bands such as the cellular telephone bands at 850 MHz, 900 MHz, 1800 MHz, and 1900 MHz, data service bands such as the 3 G data communications band at 2100 MHz band (commonly referred to as UMTS or Universal Mobile Telecommunications System), Wi-Fi® (IEEE 802.11) bands (also sometimes referred to as wireless local area network or WLAN bands), the Bluetooth® band at 2.4 GHz, and the global positioning system (GPS) band at 1575 MHz. Wi-Fi bands that may be supported include the 2.4 GHz band and the 5.0 GHz bands. The 2.4 GHz Wi-Fi band extends from 2.412 to 2.484 GHz. Commonly-used channels in the 5.0 GHz Wi-Fi band extend from 5.15-5.85 GHz, so the 5.0 GHz band is sometimes referred to by the 5.4 GHz approximate center frequency for this range (i.e., these communications frequencies are sometimes referred to as making up a 5.4 GHz communications band). Device 10 can cover these communications bands and/or other suitable communications bands with proper configuration of antennas such as antenna 20.

Antenna 20 may be formed from a conductive surface that has one or more dielectric-filled openings. These openings, which may sometimes be referred to as slots, may serve as resonating elements for antenna 20. The conductive surface from which antenna 20 is formed may sometimes be referred to as a ground plane element or ground plane and is typically coupled to an antenna ground terminal. In this type of configuration, one antenna pole may be formed by a dielectric-filled antenna resonating element slot and one antenna pole may be formed by the ground plane.

A slotted antenna of this type may be formed from any suitable conductive surface. For example, antenna 20 may be formed from a conductive surface that makes up a portion of a conductive housing for device 10. Antenna 20 may also be formed from a conductive surface that is located on an interior component of device 10 such as a conductive surface on a printed circuit board. Combinations of these arrangements or other suitable arrangements may also be used.

Figure 2:
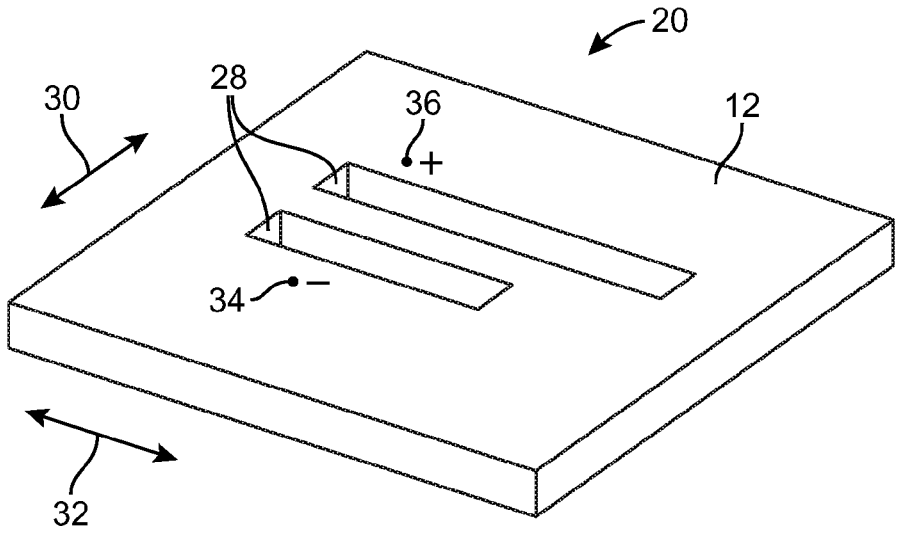
FIG. 2 is a perspective view of an illustrative slot antenna that has been formed in a conductive housing wall of an electrical device in accordance with an embodiment of the present invention.

An illustrative embodiment of antenna 20 in which antenna 20 has been formed from an exterior housing surface of device 10 is shown in FIG. 2. As shown in FIG. 2, antenna 20 may have a ground plane element formed from conductive housing 12. Slots 28 may be formed in housing 12. In the example of FIG. 2, there are two slots 28. This is merely illustrative. Antenna 20 may have one slot, two slots, three slots, more than three slots, or any other suitable number of slots.

Any suitable feed arrangement may be used for antenna 20. For example, a transmission line may be connected to antenna terminals 34 and 36. If desired, an impedance matching network may be coupled to the antenna (e.g., at terminals such as terminals 34 and 36).

In antenna 20 of FIG. 2, conductive surface 12 may be any conductive external surface associated with electronic equipment such as electronic device 10 (e.g., a handle surface, a surface associated with a base or other support structure, etc.). In a typical scenario, conductive surface 12 is a substantially planar conductive housing surface. Such conductive structures are sometimes referred to as device housings, devices cases, housing or case walls, housing or case surfaces, etc.

Slots 28 may be filled with a dielectric such as air or a solid dielectric such as plastic or epoxy. An advantage of filling slots 28 with a solid dielectric material is that this may help prevent intrusion of dust, liquids, or other foreign matter into the interior of device 10.

In general, slots 28 may have any suitable shape. For example, slots 28 may have shapes with curved sides, shapes with bends, circular or oval shapes, non-rectangular polygonal shapes, combinations of these shapes, etc. In a typical arrangement, which is described herein as an example, slots 28 may be substantially rectangular in shape and may have narrower dimensions (i.e., widths measured parallel to lateral dimension 30) and longer dimensions (e.g., lengths L measured parallel to longitudinal dimension 32). This is merely illustrative. Slots 28 may have any suitable non-rectangular shapes (e.g., shapes with non-perpendicular edges, shapes with curved edges, shapes with bends, etc.). The use of rectangular slot configurations is only described herein as an example.

Whether straight, curved, or having shapes with bends, the widths (i.e., the narrowest lateral dimensions) of slots 28 are typically much less than their lengths. For example, the widths of slots 28 may be 5-5000 times less than the lengths of slots 28 (as an example). Slots 28 may be narrow or wide. Narrow slot configurations may be characterized by slot widths of less than about 200 microns (as an example). Wide slot configurations may be characterized by slot widths that are greater than about 200 microns (as an example).

Illustrative widths that may be used for narrow slots are on the order of microns, tens of microns, or hundreds of microns (e.g., 5-200 microns, 10-30 omicrons, less than 100 microns, less than 50 microns, less than 30 microns, etc.). Illustrative widths for larger slots are on the order of fractions of a millimeter, a millimeter, more than one millimeter, etc.

Slots 28 that have particularly small widths (e.g., tens of microns) are generally invisible to the naked eye under normal observation. Slots 28 that have somewhat larger widths (e.g., hundreds of microns) may be barely visible, but will generally be unnoticeable under normal observation. For example, on a shiny metallic surface of a laptop computer, slots such as slots 28 of antenna 20 in FIG. 2 may be barely visible in the form of a slight change in the sheen of the surface when viewed from an oblique angle. The use of narrow slots 28 to form an antenna on a housing surface therefore allows the antenna to be located in prominent device locations without becoming obtrusive. For example, antenna 20 may be formed on normally exposed portions of housing 12. Examples of normally exposed housing portions include the exterior surfaces of a laptop computer or other device 10, surfaces of a laptop computer such as the housing surface adjacent to the keyboard or display (e.g., when the cover of a laptop computer has been opened for use), or housing sidewalls.

Slots that are larger (e.g., fractions of a millimeter or a millimeter or larger) may be large enough to form a visible pattern on the surface of device 12 (e.g., to form a logo or other desirable antenna window pattern).

The lengths of slots 28 may be on the order of millimeters or centimeters (e.g., 10 mm or more) or may be any other suitable length. With one suitable arrangement, both ends of the slots are surrounded by conductor (i.e., the slots are close-ended) and the lengths of slots 28 are selected so that the slots are about half of a wavelength at a desired antenna operating frequency. If desired, slots 28 may have open ends. If a slot has an open end, the slot may be configured to have a length that is equal to about a quarter of a wavelength at its desired antenna operating frequency.

Slots 28 may be spaced apart by any suitable amount. As an example, there may be about 1 to 1.5 mm, 0.5 to 2 mm, or 0.25 to 3 mm of lateral separation between adjacent pairs of slots. These are merely illustrative examples. Slots 28 may be separated by any suitable distance (e.g., less than 0.5 mm, less than 1 mm, less than 2 mm, more than 2 mm, etc.).

The spacings between the slots in a given antenna 20 need not be uniform. For example, in arrangements where there three or more slots 28, some slots 28 may be spaced apart by 1 mm lateral separations and other slots may be spaced apart by 1.5 mm lateral separations. In other suitable configurations, each pair of adjacent slots may be separated by a different distance. Combinations of these slot spacing schemes may also be used.

The slots in antenna 20 may have the same lengths or may have different lengths. For example, each slot 28 may have a different length. Alternatively, some slots may have the same length and other slots may have different lengths. Slots 28 may also have different widths. The use of different combinations of slot widths, slot lengths, slot spacings, and slots shapes may be helpful in designing antennas 20 with desired performance characteristics.

Slots 28 may be formed using any suitable technique. For example, slots may be machined in metal walls or other conductive wall structures in housing 12 using laser cutting, plasma arc cutting, micromachining (e.g., using grinding tools), or other suitable techniques.

Figure 3:
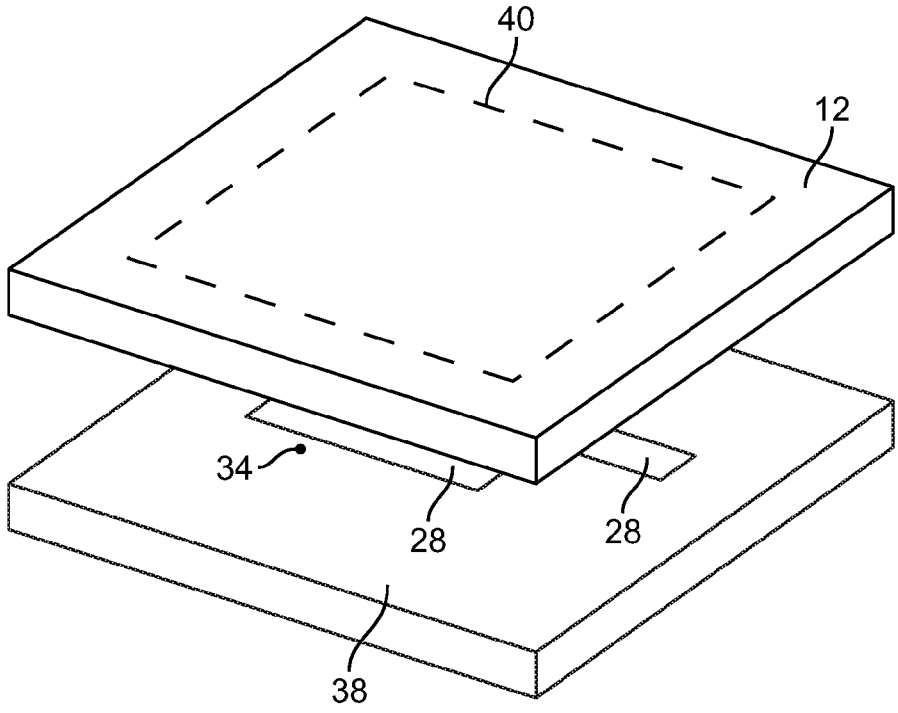
FIG. 3 is a perspective view of an illustrative slot antenna that has been mounted within an electrical device adjacent to an antenna window in a housing wall in accordance with an embodiment of the present invention.

If desired, slotted antennas 20 may be used as internal antennas in device 10. This type of arrangement is shown in FIG. 3. In the example of FIG. 3, antenna 20 has two slots 28 in a conductive ground plane element 38. Ground plane 38 may be formed from a conductive layer on a rigid or flexible printed circuit board, from a conductive layer that is part of an electrical component housing, from other suitable conductive structures in device 10, or from a combination of such structures. An example of a rigid printed circuit board substrate is fiberglass-filled epoxy. An example of a flexible printed circuit board material is polyimide.

To allow radio-frequency signals from antenna 20 to be conveyed satisfactorily through housing wall 12, housing wall 12 may be constructed from a dielectric material such as plastic. If desired, a conductive housing wall 12 may be provided with a window 40 that is transparent to radio-frequency signals. In this type of situation, antenna 20 may be mounted within device 10 in the proximity of window 40, as shown in FIG. 3.

Figure 4:
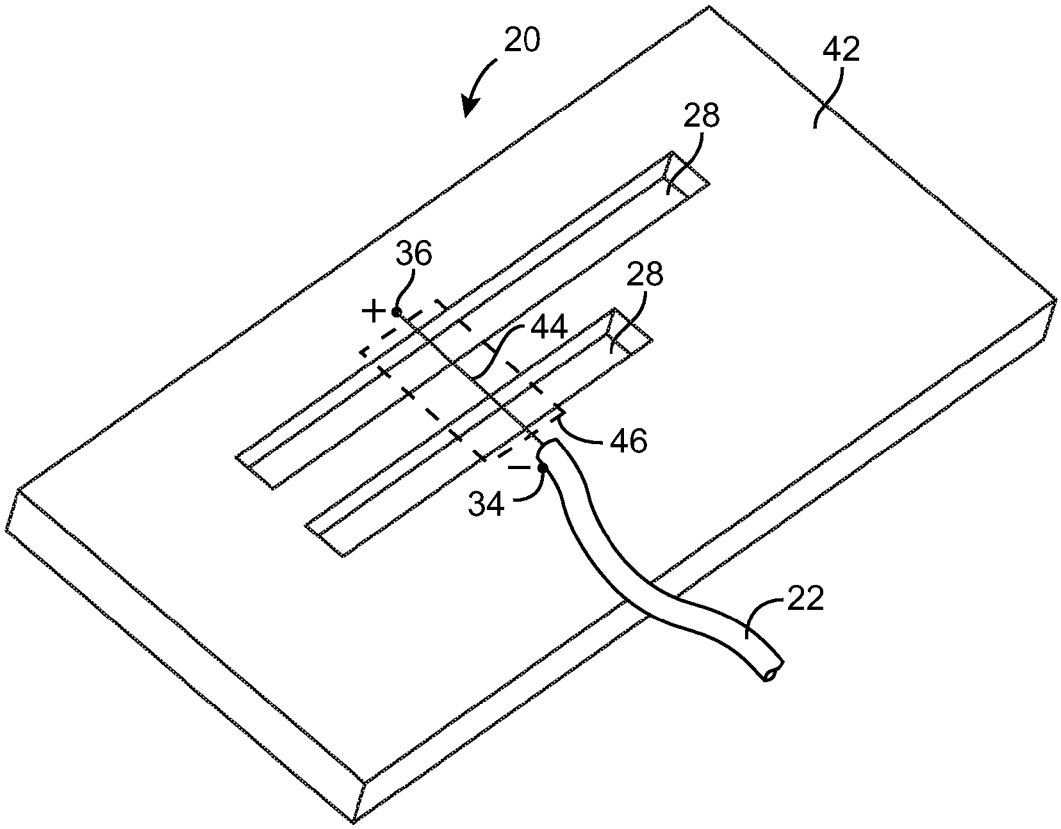
FIG. 4 is a perspective view of an illustrative dual-slot antenna in accordance with an embodiment of the present invention.

As shown in FIG. 4, a coaxial cable or other suitable transmission line 22 may be coupled to antenna 20 at feed terminals such as feed terminals 34 and 36. In antenna 20 of FIG. 4, slots 28 are formed from dielectric-filled openings in ground plane element 42. Feed terminal 34 may be referred to as a ground or negative feed terminal and may be connected to the outer (ground) conductor of transmission line 22 and ground plane 42. Feed terminal 36 may be referred to as the positive antenna terminal. Transmission line center conductor 44 may be used to connect transmission line 22 to positive feed terminal 36. If desired, other types of antenna coupling arrangements may be used (e.g., based on near-field coupling, using impedance matching networks, etc.).

As shown schematically by dashed line 46 in FIG. 4, the feed arrangement for antenna 20 may include a matching network. Matching network 46 may include a balun (to match an unbalanced transmission line to a balanced antenna or to match a balanced transmission line to an unbalanced antenna) and/or an impedance transformer (to help match the impedance of the transmission line to the impedance of the antenna).

Figure 5:
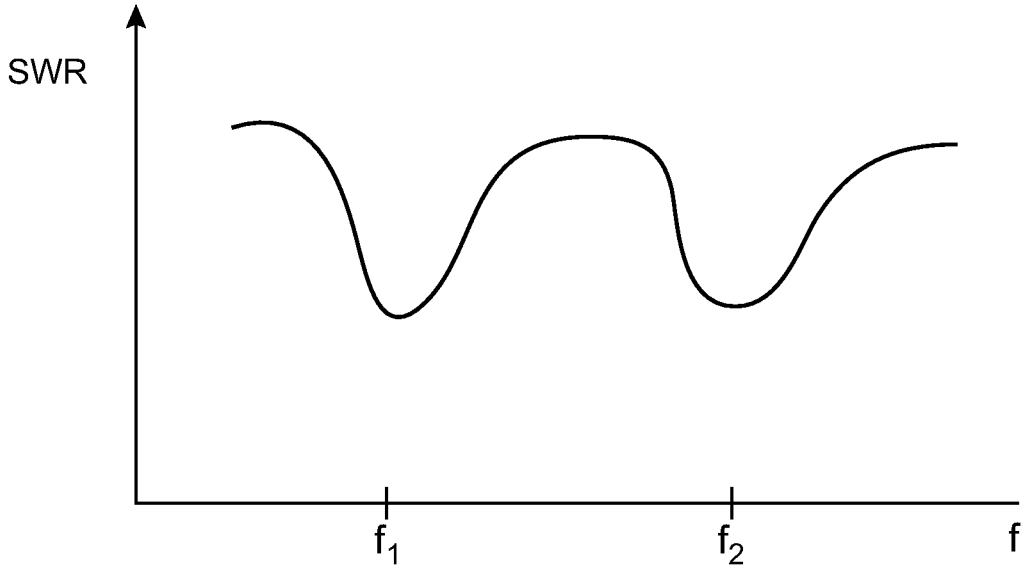
FIG. 5 is a graph showing how an antenna such as an antenna of the type shown in FIG. 4 may be used to cover multiple communications bands in accordance with an embodiment of the present invention.

An illustrative performance graph for an antenna such as antenna 20 of FIG. 4 is shown in FIG. 5. As shown in FIG. 5, a slotted antenna such as antenna 20 of FIG. 4 may cover multiple communications bands of interest. In particular, antenna 20 of FIG. 4 may cover a first communications band at frequency f1 and a second communications band at frequency f2. The first band may be (for example) the 2.4 GHz IEEE 802.11 band and the second band may be (for example) the 5.0 GHz IEEE 802.11 band (sometimes referred to by its approximate center frequency of 5.4 GHz). In a dual-slot configuration for antenna 20, a shorter of the two slots may be configured to resonate in the communications band at frequency f2 and a longer of the two slots may be configured to resonate in the communications band at f1. Additional slots (or slot shapes) may be provided to widen the bandwidth of the antenna in a given band.

The impedance of a slot antenna may be influenced by the location of the antenna feed relative to slots 28. When adjusting the impedance of the slots in a given antenna, the position and shapes of the slots may be adjusted. The locations of the feed terminals may also be adjusted. Consider, for example, a situation of the type shown in FIG. 4. In the FIG. 4 example, antenna 20 has two slots. The left-most ends of slots 28 in FIG. 4 are aligned with one another and feed terminals 34 and 36 (and optional matching network 46) are located roughly in the center of the length of the shorter slot 28. The impedance of each slot may be adjusted by adjusting the positions of each slot 28 independently relative to feed terminals 34 and 36 (and optional matching network 46).

Figure 6:
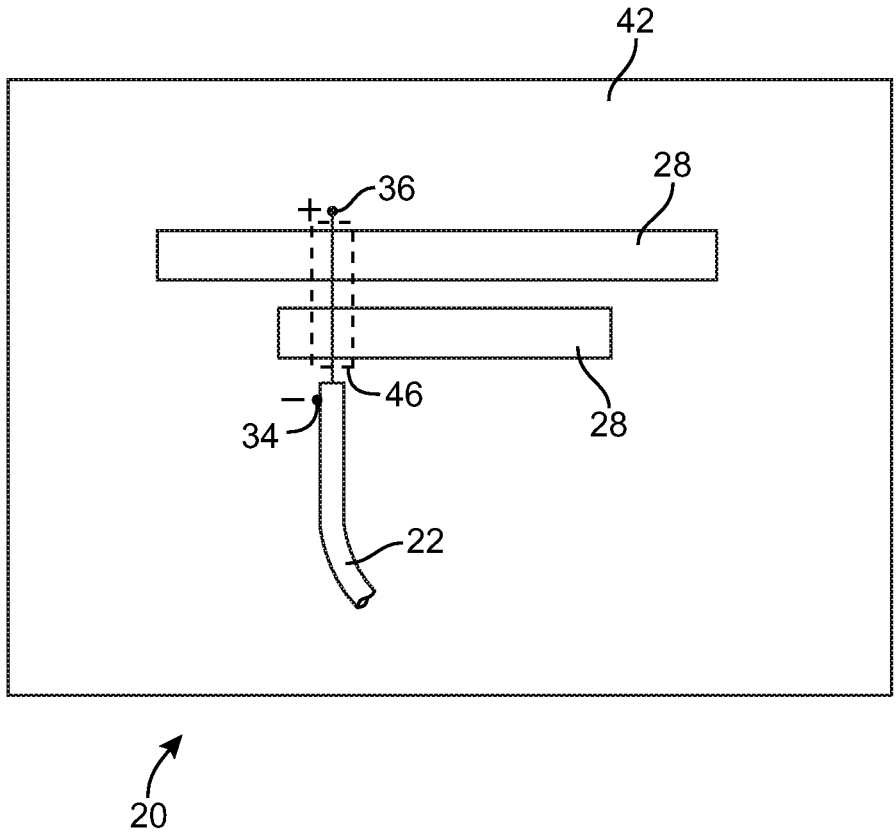
FIG. 6 is a top view of an illustrative dual-slot antenna showing an alternative position for antenna feed terminals relative to the slots in a dual-slot antenna configuration of the type shown in FIG. 4 in accordance with an embodiment of the present invention.

For example, if the shorter slot 28 of FIG. 4 is moved to the right and if antenna terminals 34 and 36 are moved to the left, antenna 20 may have a configuration of the type shown in FIG. 6. If it is desired to adjust the impedance of the shorter slot without adjusting the impedance of the longer slot, the shorter slot can be moved to the left or right (in the orientation of FIG. 6), while terminals 34 and 36 are held stationary relative to the longer slot. Alternatively, the position of the longer slot may be adjusted while maintaining the shorter slot in a fixed position. Impedance adjustments may also be made by moving the position of antenna feed terminals 34 and 36 (and optional matching network 46) relative to both the shorter and longer slots. Using adjustments such as these, it may be possible to improve impedance matching between transmission line 22 and slots 28, thereby improving antenna efficiency.

Figure 7:
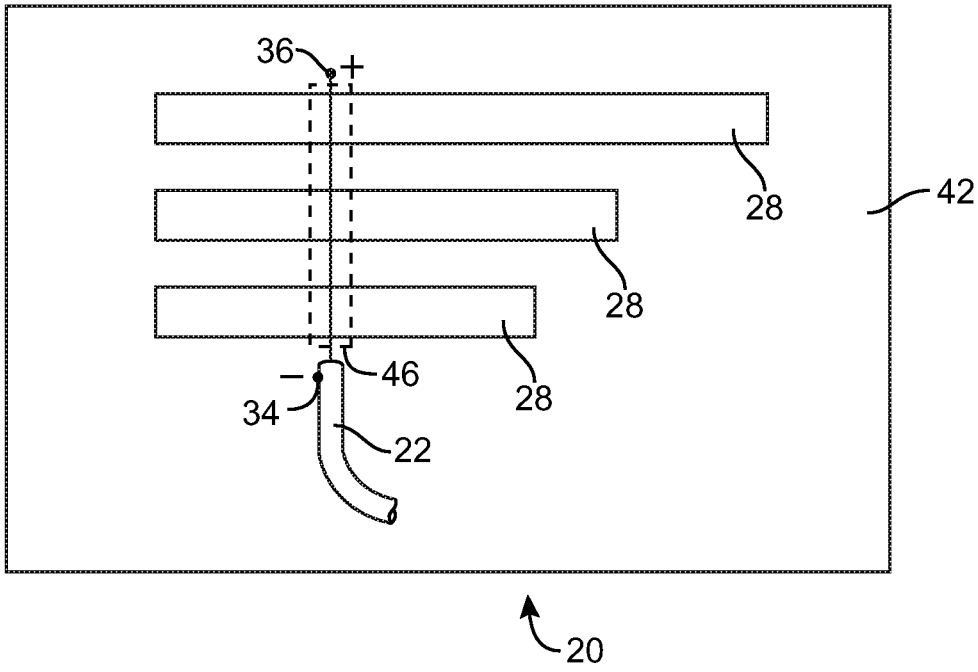
FIG. 7 is a top view of an illustrative multislot antenna having more than two slots in accordance with an embodiment of the present invention.
Figure 8:
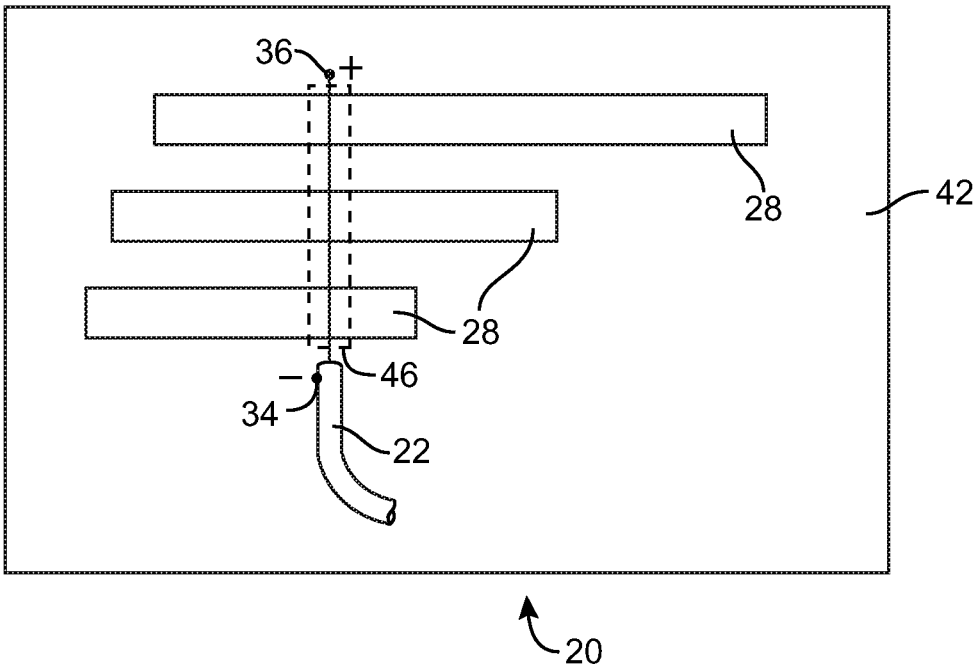
FIG. 8 is a top view of an illustrative alternative feed arrangement for a multislot antenna of the type shown in FIG. 7 in accordance with an embodiment of the present invention.

If desired, impedance adjustments such as these may be made in antenna configurations that have more than two slots. For example, consider the situation of FIG. 7. In this configuration, each slot 28 is positioned so that its leftmost end (as viewed in the orientation of FIG. 7) is aligned with that of the other slots 28. As shown in FIG. 8, impedance adjustments may be made to each of the slots 28 independently, resulting in an antenna arrangement of the type shown in FIG. 8, in which the leftmost ends of slots 28 are no longer aligned.

Figure 9:
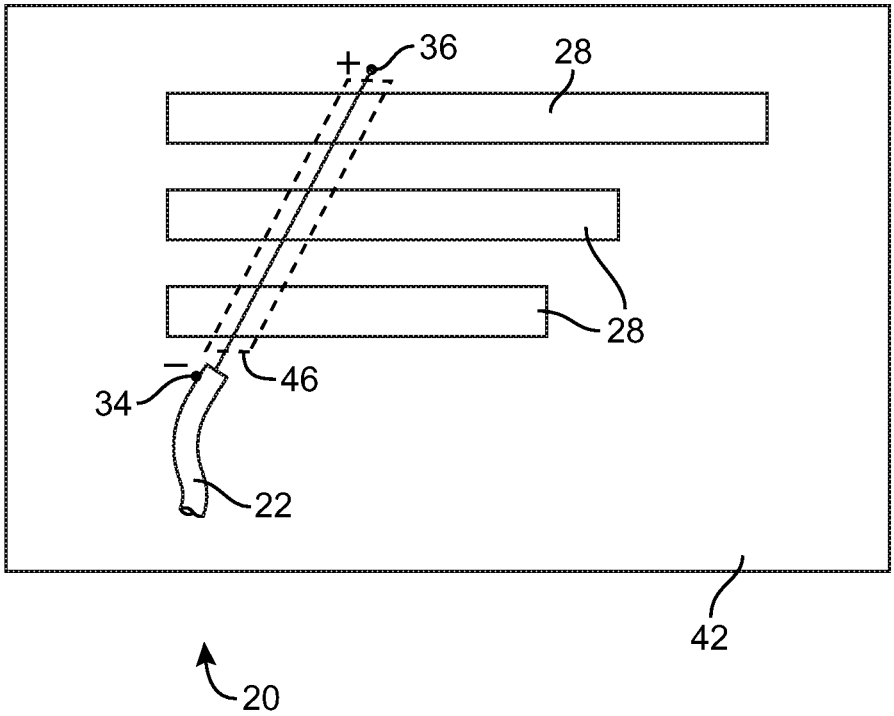
FIG. 9 is a top view of another illustrative feed arrangement for a multislot antenna of the type shown in FIG. 7 in accordance with an embodiment of the present invention.

Antenna impedance adjustments may also be made by changing the angle at which the feed terminals bridge the antenna slots. This type of arrangement is shown in FIG. 9. As shown in FIG. 9, it is not necessary for antenna terminals 34 and 36 to bridge slots 28 at a perpendicular angle. Rather, terminals 34 and 36 (and optional matching network 46) may be positioned at an angle relative to slots 28. This approach may be used when it is desirable to make independent impedance adjustments for slots 28 without changing the relative positions of slots 28 to each other (e.g., to accommodate an antenna layout in which slots 28 are aligned with each other at one end as shown in the FIG. 9 example). In angled feed arrangements of the type shown in FIG. 9, coupling efficiency may be somewhat lower than when perpendicular feed arrangements are used.

Nevertheless, angled feed arrangements may be desirable in situations in which geometric constraints make it difficult or impossible to use a perpendicular feed configuration.

Matching network 46 may be formed from any suitable components. Examples of components that may be used include surface mount components and components formed from circuit board traces. With one suitable arrangement, which is described herein as an example, a capacitive feed arrangement is formed using a planar conductive element. This type of element, which is sometimes referred to as a conductive strip or conductive strap may be formed from metal, metal alloys, conductive elements with a dielectric backing (e.g., metal or metal alloy layers on a flex circuit or rigid printed circuit board substrate), other conductive materials, combinations of such materials, etc.

Figure 10:
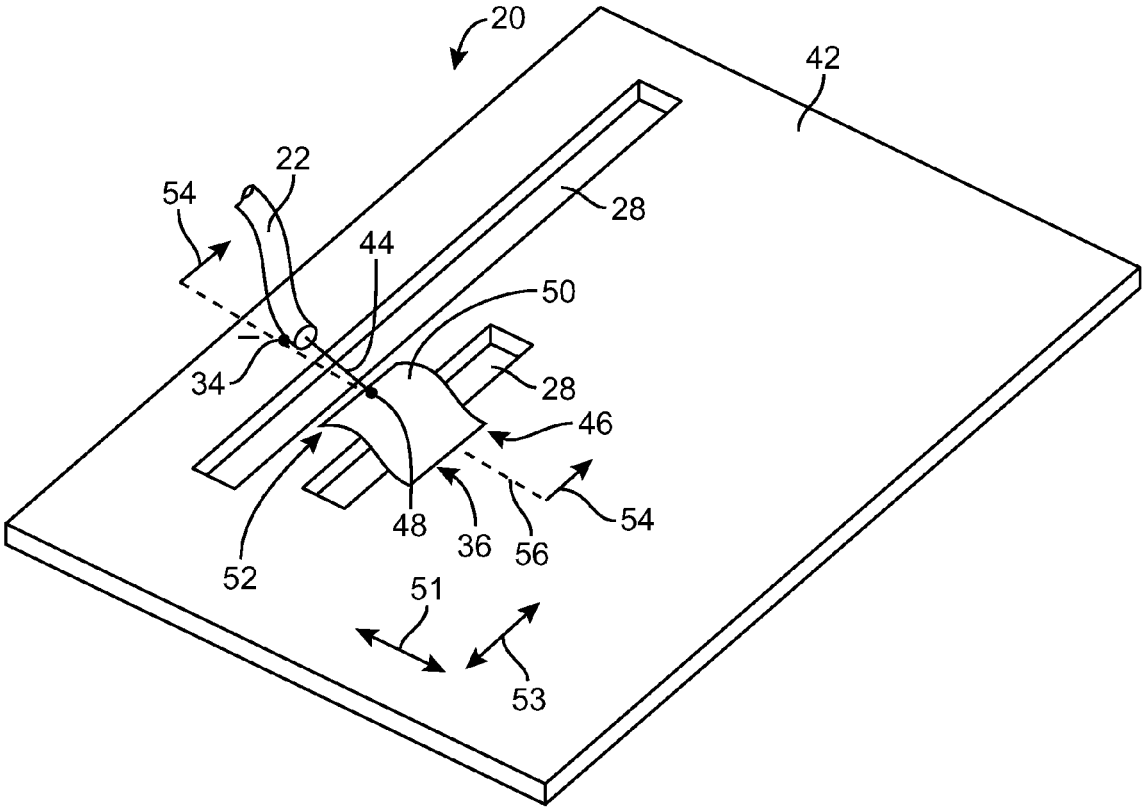
FIG. 10 is a perspective view of an illustrative slot antenna with a matching network formed from a conductive planar element in accordance with an embodiment of the present invention.

An illustrative matching network 46 formed from a layer of conductive material is shown in FIG. 10. As shown in FIG. 10, coaxial cable transmission line 22 may be configured so that its outer ground conductor is connected to ground plane 42 at ground terminal 34. Center conductor 44 may be connected to planar conductive element 50 at a location such as location 48. In the configuration illustrated in FIG. 10, antenna 20 has two slots 28 formed in ground plane 42. Planar conductive element 50 is configured to span the shorter of the two slots. Part of conductive planar element 50 is connected to ground plane 42 and forms positive antenna feed terminal 36. The other portions of conductive planar element 50 are preferably not shorted to ground plane 42.

The slots of FIG. 10 are separated by a portion of ground plane 42 (i.e., ground plane portion 52). If desired, planar conductive element 50 can overlap a portion of ground plane portion 52 as shown in FIG. 10.

Using an arrangement of the type shown in FIG. 10, an antenna designer can adjust a variety of parameters to optimize an antenna design. For example, slot length typically affects resonant frequency, so a designer can select the length of a slot along its longitudinal dimension to adjust the frequency at which the antenna will operate. The width of an antenna slot affects antenna bandwidth. Antenna slots that have larger widths will generally exhibit larger bandwidths than narrower slots. There is a practical limit to the amount that an antenna's bandwidth can be increased by increasing slot width, so in some situations it may be desirable to construct antennas from multiple parallel slots. Each slot in this type of configuration may have a different length and therefore a different resonant frequency. By combining the response of multiple parallel slots, each of which has a different resonant frequency, the bandwidth of the antenna in a particular communications band may be enhanced or coverage for one or more additional communications bands may be added.

In matching networks formed from planar conductive elements such as conductive element 50, adjustments to the size and shape of element 50 and the position of the feed terminals may be used to help match the impedance of transmission line 22 to the impedance of the antenna slot structures. An antenna slot may have an impedance that is larger or smaller than that of transmission line 22. In general, good matching may be obtained by determining optimum real and imaginary impedance values for the matching network. Put another way, both the magnitude and phase of the matching network impedance should be adjusted correctly to ensure that transmission line 22 will be efficiently coupled to the antenna slots. In arrangements of the type shown in FIG. 10, it is possible to achieve good matching, because there are several independently adjustable parameters associated with the structures of antenna 20 and its matching network, each of which has a different type of impact on the magnitude and phase of the matching network impedance.

For example, an antenna designer may make adjustments to the position of the antenna feed. If the feed is positioned near to the end of the slot, the magnitude of the impedance of the matching network will tend to be low. If the feed is positioned in the middle of the slot, the impedance magnitude will be higher. The position of the feed along the length of the slot may therefore be used to make impedance magnitude adjustments. These adjustments affect mostly the magnitude of the matching network impedance, rather than its phase.

Adjustments can also be made to conductive planar structure 50. Adjustments in the length of structure 50 (i.e., adjustments in the lateral dimension of structure 50 measured along direction 51) tend to affect primarily the phase or reactive (imaginary) component of the matching network impedance. Adjustments in the width of structure 50 (i.e., adjustments in the longitudinal dimension of structure 50 measured along direction 53) tend to affect primarily the magnitude of the impedance. When the impedance of the slot is high, it may be desirable to use a relatively narrower width for conductive planar structure 50, because narrower widths result in higher impedance values for the matching network. When the impedance of the slot is low, it may be desirable to use a relatively wider width for conductive planar structure 50.

The way in which length adjustments for structure 50 affect primarily the real component of the impedance whereas width adjustments affect primarily the imaginary component of the impedance allows an antenna designer to create a matching network with a desired balance of real and imaginary impedance components. The position of the feed along the slot length provides an additional degree of freedom. Further adjustability is provided by varying the dielectric constant of the material in the slot (or in the vicinity of the slot). The dielectric constant of air is less from that of epoxy, so when it is desired to increase the dielectric constant in the vicinity of the antenna slot, the slot can be filled with epoxy (as an example). The antenna's resonant frequency and bandwidth can be adjusted by making dielectric loading adjustments of this type, by making adjustments to the slot length, by changing the slot width, by selecting an appropriate number of slots, etc. The availability of these independently adjustable parameters makes it possible to design matching networks and slot antennas such as antenna 20 of FIG. 10 in which coupling between transmission line 22 and slots 28 is optimized and in which the antenna covers desired communications frequencies.

Figure 11:
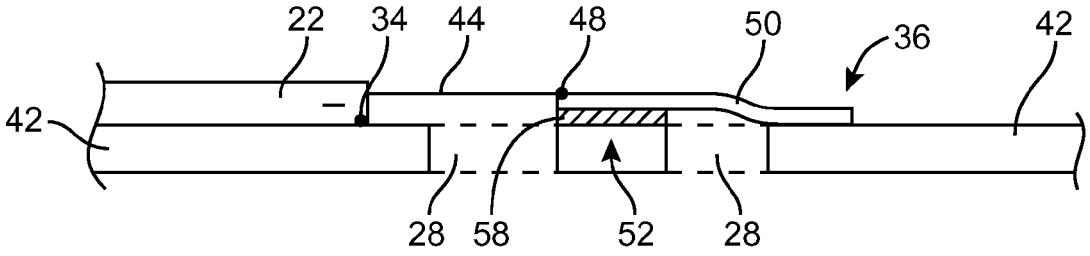
FIG. 11 is a cross-sectional side view of an illustrative slot antenna and matching network of the type shown in FIG. 10 in accordance with an embodiment of the present invention.

A cross-sectional diagram of antenna 20 of FIG. 10 taken along dashed line 56 and viewed in direction 54 is shown in FIG. 11. As shown in FIG. 11, there is preferably a dielectric-filled gap 58 between planar conductive structure 50 and ground plane portion 52 of ground plane 42. Dielectric-filled gap 58 may be filled with air or a solid dielectric such as plastic, epoxy, polyimide, or other suitable dielectric. The dielectric and the separation between conductive planar element 50 and ground plane portion 52 create a feed capacitance that can help match the impedance of transmission line 22 to the impedance of slots 28. Because dielectric 58 is not conductive, planar conductive element 50 is not electrically connected to the underlying ground plane portion 52.

In a typical situation, transmission line 22 may have an impedance (e.g., 50 ohms) that is larger than the impedance of slots such as slots 28 (e.g., 20 ohms). Conductive planar structure 50 may be used to form an impedance matching network (e.g., a matching network such as optional matching network 46 of FIG. 4) that helps to alleviate undesirable impedance mismatch discontinuities between slots 28 and transmission line 22 that might reduce antenna coupling efficiency. If desired, other matching network components (e.g., surface mount or discrete components such as resistors, capacitors, and inductors) may be combined with a matching network structure formed from planar elements such as conductive planar element 50.

Figure 12:
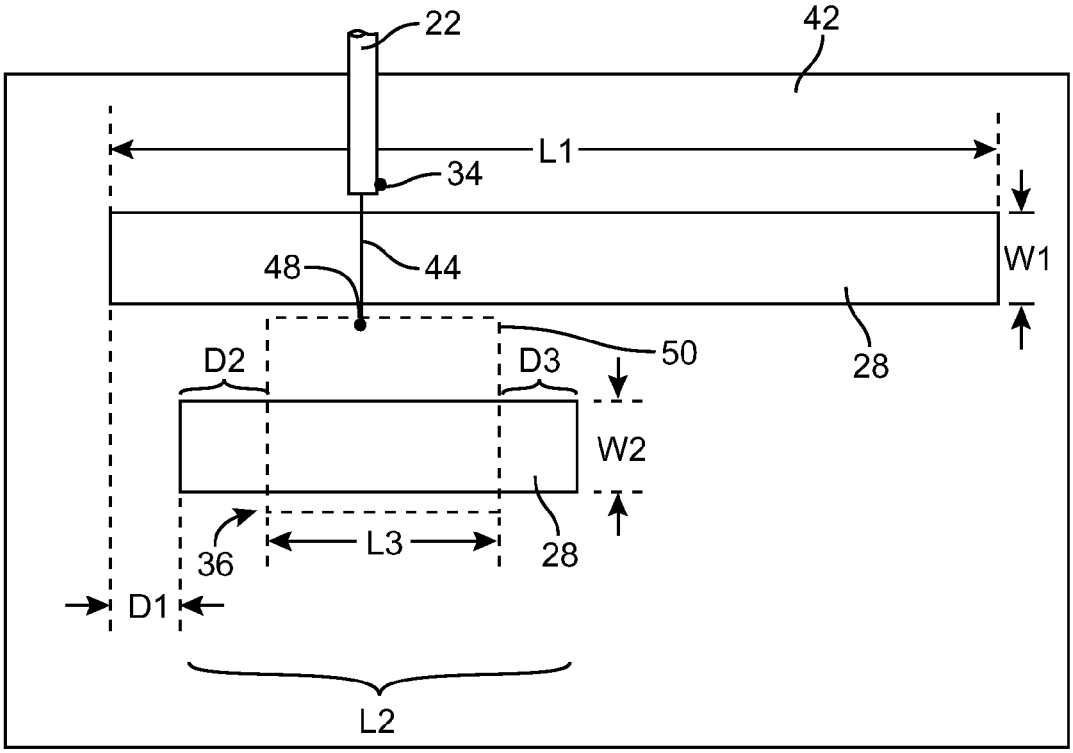
FIG. 12 is a top view of an illustrative slot antenna having two slots and an impedance matching network structure in accordance with an embodiment of the present invention.

Any suitable sizes and shapes may be used for slots 28 and planar conductive element 50 if desired. An example is shown in FIG. 12. As shown in FIG. 12, antenna 20 may have a larger slot of length L1 and width W1 and may have a shorter slot of length L2 and width W2. The lengths L1 and L2 may be selected to be about a half of a wavelength at signal frequencies associated with communications bands of interest (e.g., the 2.4 GHz band for length L1 and the 5.0 GHz band for length L2). Length L1 may be 61 mm. Width W1 may be 0.8 mm. Length L2 may be 23.5 mm. Width W2 may be 0.82 mm. There may be a lateral separation of 1.43 mm between slots 28. The left end of the smaller slot may be offset from the left end of the longer slot by an offset distance D1 of 1.5 mm. Planar conductive element 50 may have a length L3 of 8.65 mm. Distances D2 and D3 may be equal to 4.55 mm and 10.3 mm, respectively. Distances such as distance D1 and the dimensions of the structures in FIG. 12 may be adjusted to tune the impedance matching capabilities of the matching network formed using planar conductive element 50.

Figure 13:
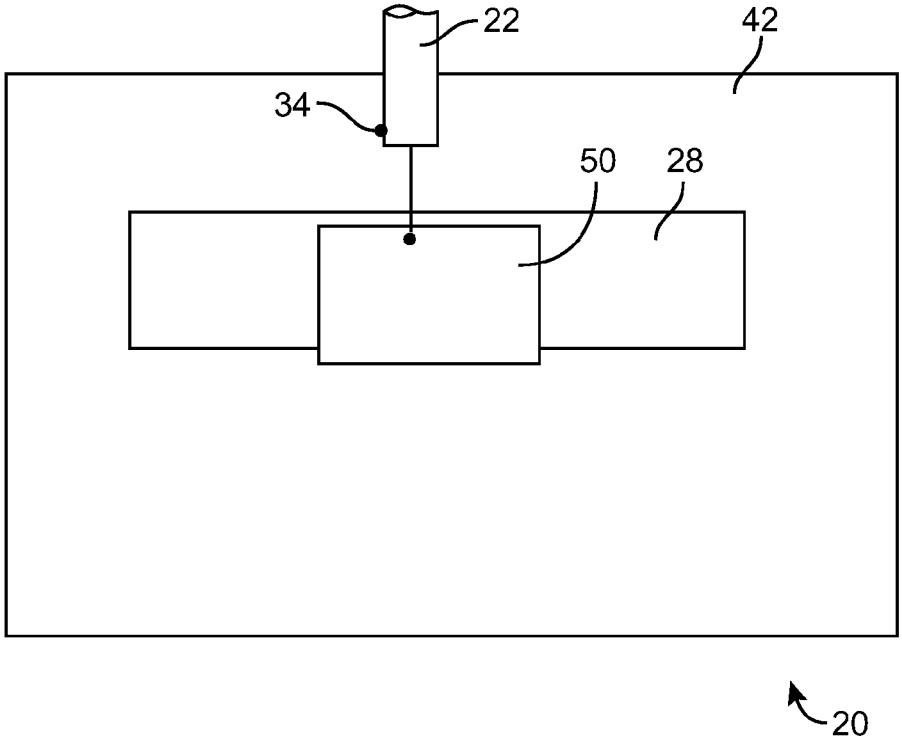
FIG. 13 is a top view of an illustrative single-slot antenna having an impedance matching network structure that substantially covers the width of the antenna slot in accordance with an embodiment of the present invention.
Figure 14:
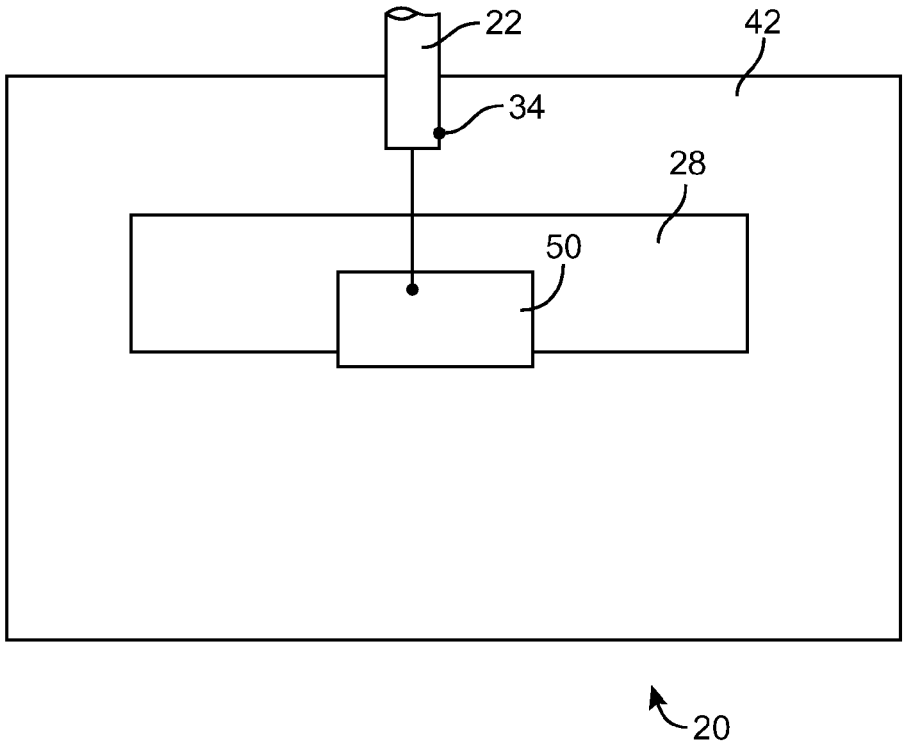
FIG. 14 is a top view of an illustrative single-slot antenna having an impedance matching network structure that partially covers the width of the antenna slot in accordance with an embodiment of the present invention.

As shown in FIG. 13, the size of planar conductive element 50 may be selected so that planar conductive element 50 just spans the width of antenna slot 28. In the example of FIG. 14, planar conductive element 50 only partially bridges the width of slot 28.

Figure 15:
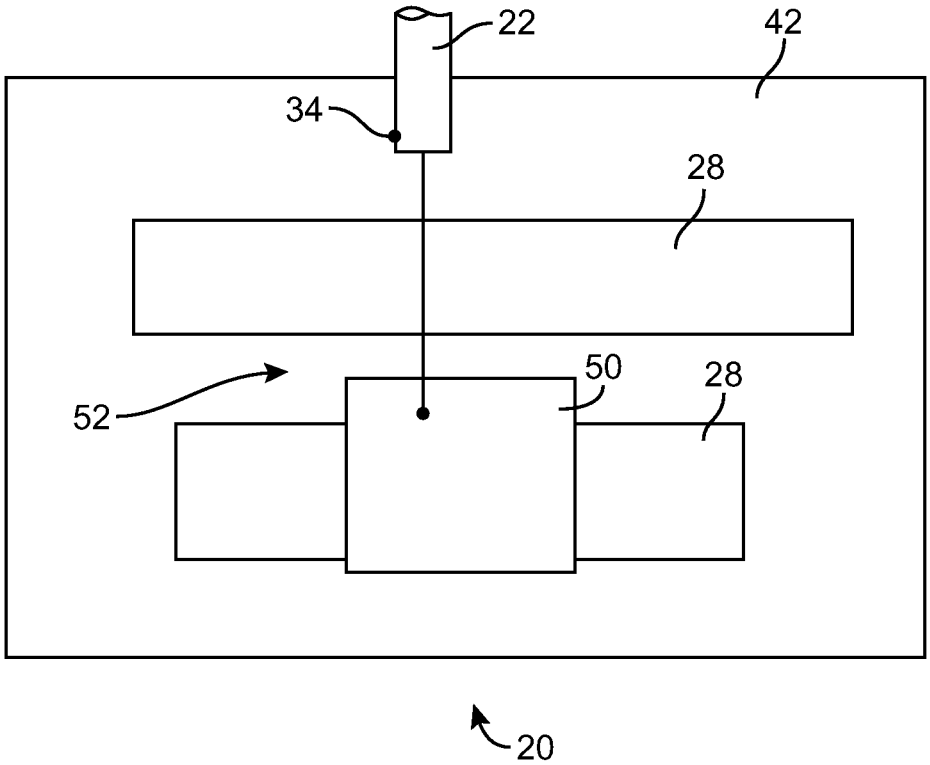
FIG. 15 is a top view of an illustrative dual-slot antenna having an impedance matching network structure that substantially covers the width of one of the antenna slots in accordance with an embodiment of the present invention.

Another illustrative configuration is shown in the dual-slot antenna of FIG. 15. As shown in FIG. 15, planar conductive element 50 may completely bridge an antenna slot and may partially overlap the region of ground plane 42 that lies between slots 28 (i.e., region 52).

Figure 16:
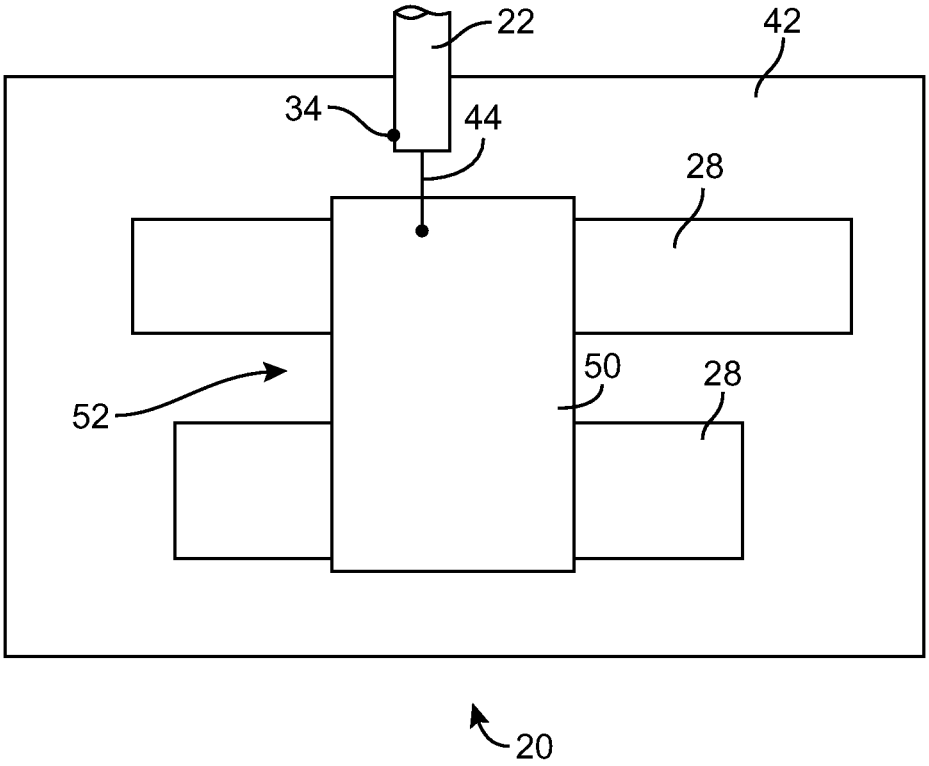
FIG. 16 is a top view of an illustrative dual-slot antenna having an impedance matching network structure that substantially covers the widths of both of the antenna slots in accordance with an embodiment of the present invention.

If desired, planar conductive element 50 may span the widths of both slots 28 in a dual-slot antenna. This type of arrangement is shown in FIG. 16. As shown in FIG. 16, planar conductive region 50 may cover the width of the shorter of the two slots 28, may cover the width of the larger of the two slots 28, and may span the width of region 52 of ground plane 42.

Figure 17:
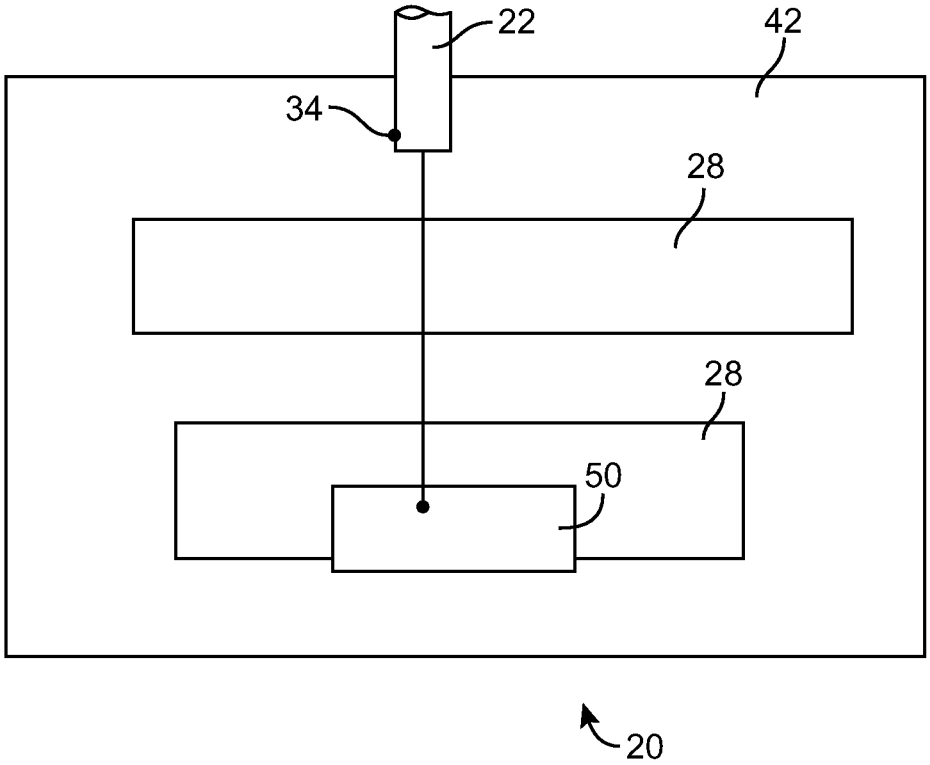
FIG. 17 is a top view of an illustrative dual-slot antenna having an impedance matching network structure that partially covers the width of one of the antenna slots in accordance with an embodiment of the present invention.

It is not necessary for planar conductive element 50 to completely bridge the shorter slot in a two-slot antenna. As shown in FIG. 17, for example, planar conductive element 50 in dual-slot antenna 20 may only partially bridge the shorter of the two slots in antenna 20.

Figure 18:
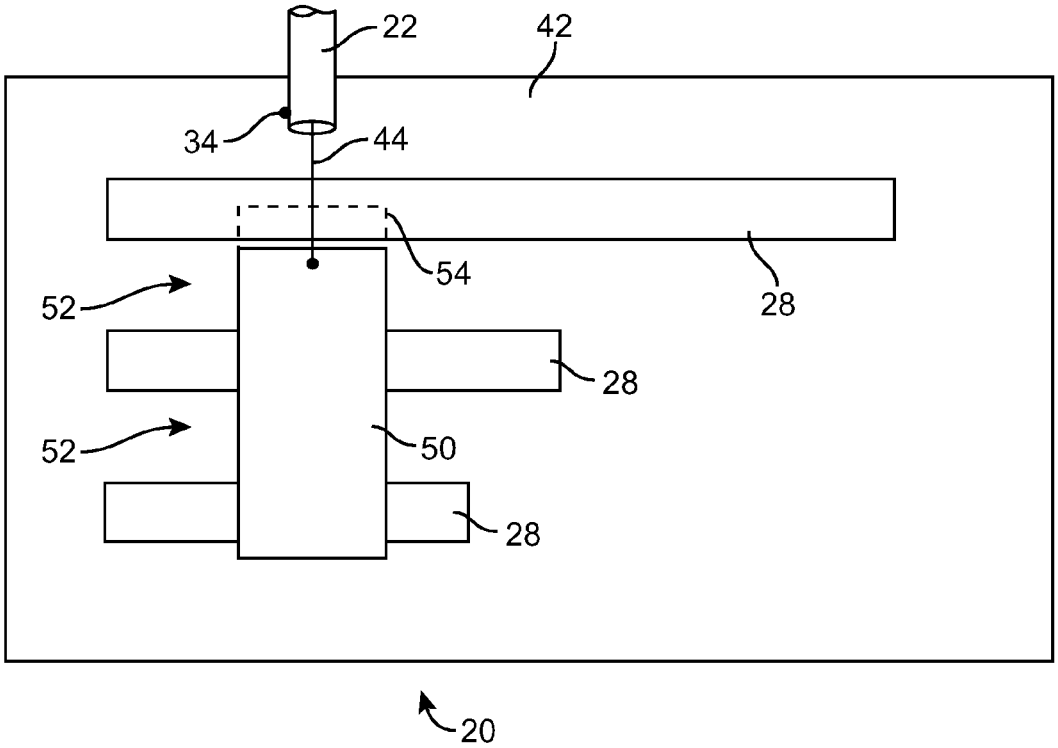
FIG. 18 is a top view of an illustrative slot antenna having three slots and having an impedance matching network structure that spans the widths of at least two of the slots in accordance with an embodiment of the present invention.

The size of planar conductive element 50 may also be adjusted in slotted antennas having more than two slots. As shown in FIG. 18, for example, planar conductive element 50 may be configured to overlap two slots 28 and two ground plane slot separation regions 52. Dashed line 54 illustrates how planar conductive element 50 may, if desired, partially span the third of the three slots in antenna 20 of FIG. 18. Other arrangements in a three-slot antenna are also possible. For example, planar conductive element 50 may bridge all three slots completely, may partially bridge either of regions 52, may partially bridge either of the shorter two slots, etc.

Figure 19:
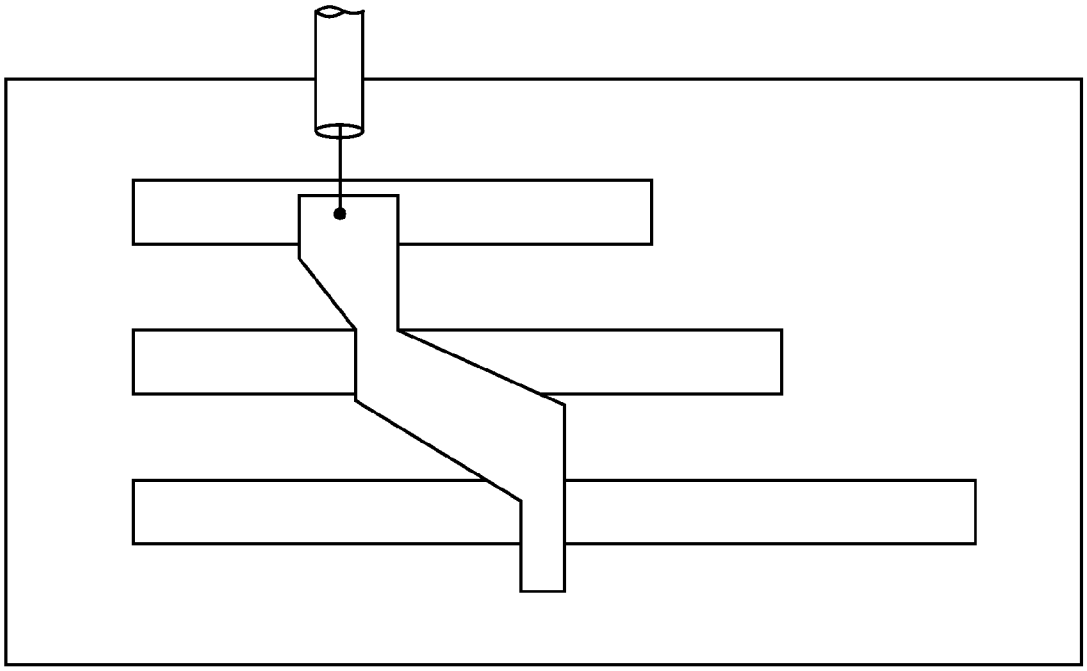
FIG. 19 is a top view of an illustrative slot antenna having an impedance matching network structure that is configured to provide various amount of impedance matching to each slot in accordance with an embodiment of the present invention.

Planar conductive elements such as planar conductive element 50 need not be rectangular in shape. An example of a planar conductive element 50 that has a non-rectangular shape is shown in FIG. 19. As shown in the FIG. 19 example, the area of element 50 that overlaps each slot may be different and may be adjusted independently. The longitudinal position at which planar conductive element 50 crosses each slot 28 may also be adjusted independently. The shape of planar conductive element 50 may be individually tailored wherever conductive element 50 crosses ground plane slot separation regions such as regions 52. The amount of spacing between planar conductive element 50 and underlying regions 52 and the shape and size of the overlap between planar conductive element 50 and slots 28 are additional adjustable parameters associated with antennas of the type shown in FIG. 19. These parameters and other suitable parameters may be selected to enhanced impedance matching and/or to perform other desired matching functions (e.g., the functions of a balun when it is desired to match an unbalanced transmission line to a balanced slot antenna or when it is desired to match a balanced transmission line to an unbalanced slot antenna). The configuration of FIG. 19 and the other configurations shown in the FIGS. are merely illustrative.

The foregoing is merely illustrative of the principles of this invention and various modifications can be made by those skilled in the art without departing from the scope and spirit of the invention.

What is claimed is:

1. An antenna that has an impedance and that is fed by a transmission line that has a first conductor and a second conductor, wherein the transmission line has an impedance, comprising:

a ground plane element connected to the first conductor;

at least one antenna resonating element opening formed in the ground plane element; and a planar conductive structure that bridges at least part of the antenna resonating element opening and that is connected to the second conductor, wherein the planar conductive structure has an area and is operable to, together with the ground plane element, create a feed capacitance to match the impedance of the transmission line to the impedance of the antenna, wherein the at least one antenna resonating element opening comprises first and second antenna resonating element slots, wherein the planar conductive structure overlaps a first part of the first slot, and wherein the second conductor overlaps the second slot and overlaps a second part of the first slot.

2. The antenna defined in claim 1 wherein the at least one antenna resonating element opening comprises a third antenna resonating element slot, wherein the planar conductive structure overlaps the third slot.

3. The antenna defined in claim 1 wherein a ground plane portion of the ground plane element lies between the first and second antenna resonating element slots and wherein at least some of the planar conductive structure overlaps part of the ground plane portion without contacting that part of the ground plane portion.

4. The antenna defined in claim 3 wherein a solid dielectric lies between the planar conductive structure and the ground plane portion.

5. The antenna defined in claim 1 wherein the ground plane element is formed from a portion of a conductive electronic device housing.

6. The antenna defined in claim 1 wherein the ground plane element is formed from a portion of a printed circuit board conductor.

7. The antenna defined in claim 1 further comprising solid dielectric that fills the first and second antenna resonating element slots.

8. An antenna that has an impedance and that is fed by a transmission line that has a first conductor and a second conductor, wherein the transmission line has an impedance, comprising:

a ground plane element connected to the first conductor;

at least one antenna resonating element opening formed in the ground plane element; and a planar conductive structure that bridges at least part of the antenna resonating element opening and that is connected to the second conductor, wherein the planar conductive structure has an area and is operable to, together with the ground plane element, create a feed capacitance to match the impedance of the transmission line to the impedance of the antenna, wherein the at least one antenna resonating element opening comprises at least first and second antenna resonating element slots, wherein the first and second antenna resonating element slots are aligned along a common longitudinal axis, wherein the planar conductive structure overlaps the first antenna resonating element slot at a first longitudinal position, wherein the planar conductive structure overlaps the second antenna resonating element slot at a second longitudinal position, and wherein the first and second longitudinal positions are different.

9. The antenna defined in claim 8 wherein at least one of the first and second antenna resonating element slots comprises a rectangular slot portion.

10. The antenna defined in claim 8 wherein a ground plane portion of the ground plane element lies between the first and second antenna resonating element slots and wherein the planar conductive structure comprises a metal strap that covers part of the ground plane portion.

11. The antenna defined in claim 8 wherein a ground plane portion of the ground plane element lies between the first and second antenna resonating element slots and wherein the planar conductive structure comprises a substantially rectangular metal strap that covers part of the ground plane portion.

12. The antenna defined in claim 8 wherein the antenna resonating element slots each have a first end and a second end, and wherein the first ends are aligned.

13. The antenna defined in claim 8 wherein the antenna resonating element slots each have a first end and a second end, and wherein the first ends are offset with respect to each other so that they are not aligned.

14. The antenna defined in claim 8 wherein the second conductor bridges at least a part of the antenna resonating element opening.

15. An antenna that is fed by a transmission line having a first conductor and a second conductor, comprising:

a ground plane;

at least first and second slots in the ground plane that are separated by a portion of the ground plane;

a conductive planar structure that bridges the first slot, that is electrically coupled to the ground plane element, and that overlaps at least a first part of the portion of the ground plane separating the first and second slots, wherein there is a gap between the conductive planar structure and the part of the ground plane that is overlapped by the conductive planar structure, wherein the first conductor is connected to the ground plane, wherein the second conductor is connected to the conductive planar structure, and wherein the second conductor overlaps at least a first part of the second slot; and a solid dielectric in the gap.

16. The antenna defined in claim 15 wherein the first slot is shorter than the second slot and wherein the first and second slots are configured to handle radio-frequency signals for respective first and second communications bands.

17. The antenna defined in claim 16 wherein the first slot is configured to handle radio-frequency signals for a 2.4 GHz communications band and wherein the second slot is configured to handle radio-frequency signals for a 5.0 communications band.

18. The antenna defined in claim 15 further comprising a solid dielectric that fills the first and second slots.

19. The antenna defined in claim 15 wherein the conductive planar structure bridges the portion of the ground plane separating the first and second slots and overlaps at least a second part of the second slot.

20. A portable electronic device, comprising:

circuitry that handles radio-frequency signals;

a transmission line coupled to the circuitry, wherein the transmission line has first and second conductors; and an antenna, wherein the antenna has:

a ground plane element;

at least first and second slots in the ground plane that are separated by a portion of the ground plane element and that serve as antenna resonating elements for the antenna; and a conductive planar structure that overlaps at least part of the slots, wherein the second conductor is connected to the conductive planar structure, wherein the first conductor is connected to the ground plane element on one side of the first and second slots without electrically contacting any of the portion of the ground plane element between the slots, wherein the conductive planar structure is connected to an opposing side of the first and second slots without electrically contacting any of the portion of the ground plane element between the slots, wherein the conductive planar structure bridges the first slot and overlaps at least a first part of the portion of the ground plane element between the slots, wherein the first slot has a width, wherein the second slot has a width, and wherein the conductive planar structure has a width that is greater than the width of the first slot and that is greater than the width of the second slot.

21. The portable electronic device defined in claim 20 wherein the ground plane element comprises a portion of a conductive housing for the portable electronic device.

22. The portable electronic device defined in claim 20 wherein the conductive planar structure overlaps the portion of the ground plane element between the slots without contacting any of that portion of the ground plane element, and wherein the antenna further comprises a solid dielectric between the conductive planar structure and some of the portion of the ground plane element that is between the slots.

23. The portable electronic device defined in claim 20 wherein the first slot is configured to handle radio-frequency signals for a first communications band and wherein the second slot is configured to handle radio-frequency signals for a second communications band, wherein the first and second communications bands do not overlap.

24. The portable electronic device defined in claim 20 further comprising a solid dielectric in the first and second slots.

25. The portable electronic device defined in claim 20 wherein the second conductor overlaps at least a first part of the second slot.

26. The portable electronic device defined in claim 25 wherein the second conductor bridges the second slot and overlaps at least a second part of the portion of the ground plane element between the slots.

27. The portable electronic device defined in claim 25 wherein the conductive planar structure bridges the portion of the ground plane element between the slots and overlaps at least a second part of the second slot.

28. An antenna that is fed by a transmission line having a first conductor and a second conductor, comprising:

a ground plane;

at least first and second slots in the ground plane that are separated by a portion of the ground plane; and a conductive planar structure that bridges the first slot, that is electrically coupled to the ground plane element, and that overlaps at least a first part of the portion of the ground plane separating the first and second slots, wherein there is a gap between the conductive planar structure and the part of the ground plane that is overlapped by the conductive planar structure, wherein the first conductor is connected to the ground plane, wherein the second conductor is connected to the conductive planar structure, wherein the second conductor overlaps at least a first part of the second slot, and wherein the second conductor bridges the second slot and overlaps at least a second part of the portion of the ground plane separating the first and second slots.

* * * * *